US011638497B2

(12) United States Patent
Sheehan

(10) Patent No.: US 11,638,497 B2
(45) Date of Patent: May 2, 2023

(54) MODULAR BEVERAGE SERVING TRAY

(71) Applicant: Thomas Sheehan, Champaign, IL (US)

(72) Inventor: Thomas Sheehan, Champaign, IL (US)

( * ) Notice: Subject to any disclaimer, the term of this patent is extended or adjusted under 35 U.S.C. 154(b) by 151 days.

(21) Appl. No.: 16/945,375

(22) Filed: Jul. 31, 2020

(65) Prior Publication Data

US 2021/0030180 A1 Feb. 4, 2021

Related U.S. Application Data

(60) Provisional application No. 62/882,332, filed on Aug. 2, 2019.

(51) Int. Cl.
*B65D 71/52* (2006.01)
*A47G 23/06* (2006.01)

(52) U.S. Cl.
CPC ..... *A47G 23/0641* (2013.01); *A47G 23/0633* (2013.01)

(58) Field of Classification Search
CPC .... B65D 71/0003; B65D 71/48; B65D 71/00; B65D 2571/0029; B65D 75/00; A47G 23/0633; A47G 23/0641
USPC ..... 206/203, 201, 199, 562
See application file for complete search history.

(56) References Cited

U.S. PATENT DOCUMENTS

| | | | | |
|---|---|---|---|---|
| 8,176,855 | B1 * | 5/2012 | Cannon | A47B 13/16 229/117.08 |
| 8,424,677 | B2 * | 4/2013 | Spivey, Sr. | B65D 71/0037 206/196 |
| 8,985,347 | B2 * | 3/2015 | Thompson | A47J 47/16 211/74 |
| 9,149,135 | B2 * | 10/2015 | Dovell | A47F 7/281 |
| 2008/0105695 | A1 * | 5/2008 | Moran | B65D 71/72 220/694 |

* cited by examiner

*Primary Examiner* — King M Chu
(74) *Attorney, Agent, or Firm* — Singleton Law Firm, P.C.; Alan R. Singleton

(57) ABSTRACT

Embodiments of the present invention provide a beverage serving tray capable of coupling multiple beverage serving trays to increase overall beverage capacity of the resulting coupled beverage serving tray. The beverage serving tray is capable of stacking with other beverage serving trays in an efficient and space saving fashion or may be stored preloaded with beverage vessels for quick and efficient preparation prior to serving. The beverage serving tray comprises a main body having a top member and bottom member, and at least one joining member joining the bottom surface to the top member. The top member includes beverage openings to accept beverages, as well as to couple additional beverage serving trays to increase beverage capacity. Multiple beverage serving trays may be coupled together by inserting beverages through aligned beverage openings of adjacent beverage serving trays in order to form a modular beverage serving tray with an increased overall carrying capacity.

10 Claims, 6 Drawing Sheets

MODULAR BEVERAGE SERVING TRAY

CROSS-REFERENCE TO RELATED APPLICATIONS

The present application claims the benefit of United States Provisional Patent Application No. 62/882,332, filed Aug. 2, 2019, which is hereby incorporated by reference in its entirety.

BACKGROUND OF THE INVENTION

The present invention relates to beverage trays. Particularly, a modular beverage serving tray having a top surface and a bottom surface, coupled by a curved plane member.

In a restaurant setting, particularly a bar or brewery setting, a patron may order a sampling of various beverages, also known as a 'flight.' A flight typically consists of anywhere from three drink samplings to twelve samplings, depending on the volume of each and the variety of beverages available to the establishment. Each sampling is served in an individual glass. Traditionally, the flight is served in a tray that accommodates all included samplings at once.

Such trays are traditionally made of wood or metal and are constructed in such a way that the tray is sturdy enough to bear the weight of the entire flight. However, current trays known in the art typically cannot be stacked or stored in an efficient way, due to solid tray bodies, heavy metal-wire-frame bodies, or other features that make the trays non-compact and unwieldy.

Additionally, the unwieldy nature of current trays reduces efficiency in preparing the flight for serving to a patron. Where space is limited in a restaurant, bar, or brewery setting, the sample glasses must be stored separately from the serving trays, usually with each sample glass being filled and then loaded into the serving tray. This limits the ability and speed with which a person may prepare and deliver a flight, and further limits the number of flights that may be prepared at a given time.

Further, known beverage trays traditionally have a set number of slots in which samples may be placed and served. An establishment is then either limited by the number of samples that may be served in a given tray, or they must serve any excess samples on a separate tray, again increasing the burden of preparing and serving the flight.

The present invention attempts to remedy the shortcomings of known beverage serving trays by providing a modular. The present invention also attempts to remedy shortcomings of beverage trays known in the art by further providing a modular tray capable of being stacked and stored in a compact space while also having the requisite stability to support numerous beverages within it.

BRIEF DESCRIPTION OF THE INVENTION

The present invention provides a beverage serving tray capable of being stacked with other beverage serving trays and configured to engage other beverage trays in a modular fashion to increase overall beverage capacity of the beverage tray. In one embodiment of the invention, the beverage tray comprises a main body having a top member and a bottom member, the top member and bottom member joined by at least one joining member. The joining member further comprises a curved structure having a radius.

The top member of the beverage tray further comprises a plurality of openings disposed therethrough, the plurality of openings configured to accept beverages. Further, a radius of each of the plurality of openings may be configured such that a beverage inserted through one of the plurality of openings is supported by a rim of the opening as well as the bottom member.

In another embodiment of the invention, the beverage tray may be configured to couple at least one additional beverage tray, such that at least one of the plurality of openings of one beverage tray is concentric with at least one of the plurality of openings of the at least one additional beverage tray. By coupling at least one additional beverage tray, a capacity of beverages that the beverage tray is capable of holding is increased. In other embodiments, additional beverage trays may be coupled together to further increase carrying capacity of the overall beverage tray. In some embodiments, the beverage tray is coupled to an additional beverage tray by way of insertion of a beverage into two concentric openings in two beverage trays. In some embodiments, each of the plurality of openings is configured to accept vessels of various sizes containing foods or food-related items, such as soups, sauces, dips, and condiments.

The methods, systems, and apparatuses are set forth in part in the description which follows, and in part will be obvious from the description, or can be learned by practice of the methods, apparatuses, or can be learned by practice of the methods, apparatuses, and systems. The advantages of the methods, apparatuses, and systems will be realized and attained by means of the elements and combinations particularly pointed out in the appended claims. It is to be understood that both the foregoing general description and the following detailed description are exemplary and explanatory only and are not restrictive of the methods, apparatuses, and systems, as claimed. More details concerning these embodiments, and others, are further described in the following figures and detailed description set forth herein below.

DETAILED DESCRIPTION OF THE INVENTION

The present invention is described in reference to the accompanying drawings and following embodiments that are presented for the purpose of illustration and should not be construed to limit the scope of the invention thereto.

The present invention relates to beverage serving trays. Particularly, a beverage serving tray capable of being stacked with other beverage serving trays and configured to engage other beverage serving trays in a modular fashion to increase overall beverage capacity of the beverage tray.

Figure 1:
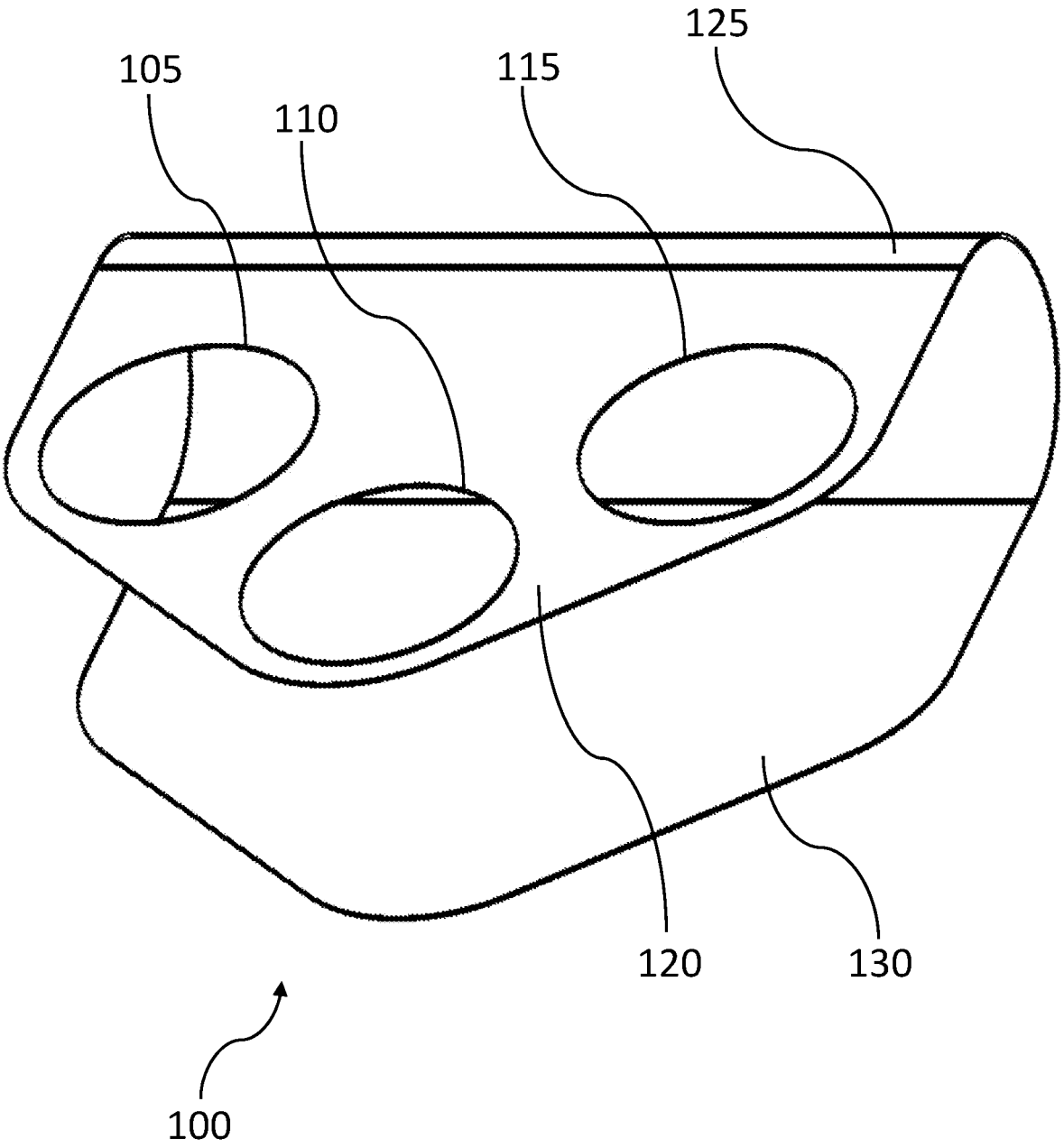
FIG. 1 illustrates a perspective view of the beverage serving tray.

FIG. 1 illustrates a perspective view of a serving tray 100, including a first opening 105, a second opening 110, a third opening 115, a top member 120, a joining member 125, and a bottom member 130. In one embodiment of the invention, the serving tray 100 comprises a main body having a top member 120 and a bottom member 130 and at least one joining member 125, wherein the top member 120 and bottom member 130 are joined by the at least one joining member 125. The at least one joining member 125 may further comprises a curved structure having a set radius.

Figure 2A:
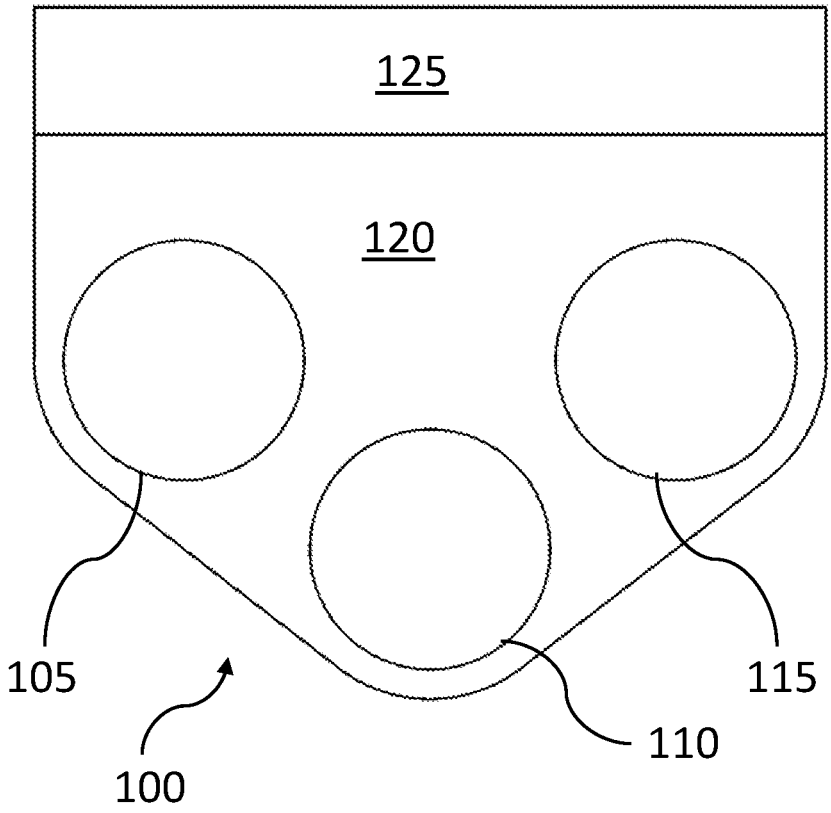
FIG. 2A illustrates a profile view of the beverage serving tray.

The top member 120 of the beverage serving tray 100 further comprises one or more beverage openings disposed therethrough, the plurality of beverage openings configured to accept beverages. In one embodiment, shown in FIG. 2A, the top member 120 includes three beverage openings: a first opening 105, a second opening 110, and a third opening 115. In an alternate embodiment, the top member 120 may include more than three beverage openings. Further, a radius of each of the plurality of beverage openings may be configured such that a beverage inserted through one of the plurality of beverage openings is supported by a rim of that beverage opening as well as the bottom member 130. Additionally, each of the plurality of beverage openings may have a radius such that various different shapes of beverage vessels may be inserted therethrough. Each of the plurality of beverage openings may further comprise differing radii to accommodate differing sizes of beverage vessels at once.

Figure 5:
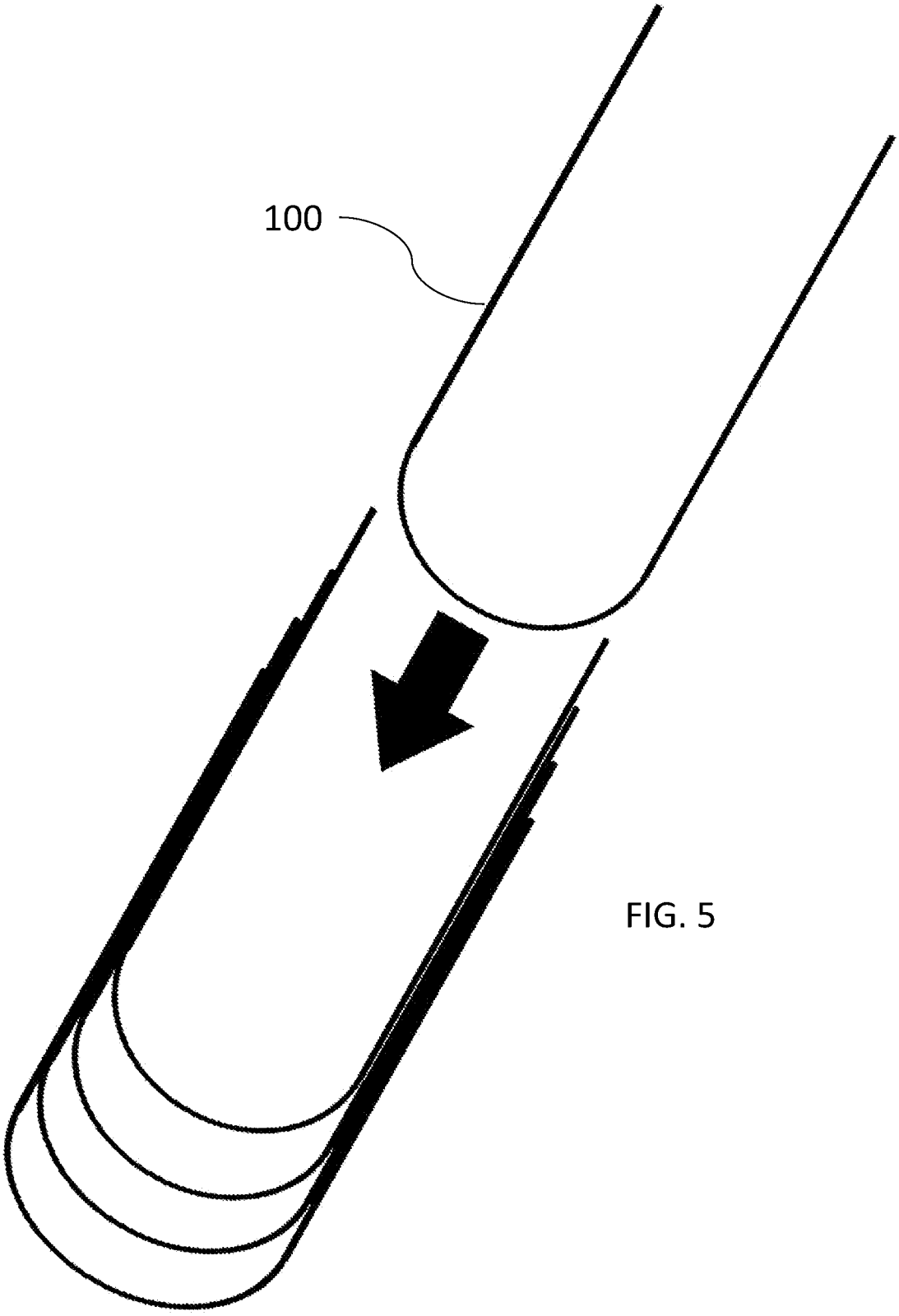
FIG. 5 illustrates a profile view of a stack of beverage serving trays for storage.

The top member 120 and bottom member 130 of the beverage serving tray may be made of a rigid or semi-rigid material, such as metal, configured to provide structural stability and support beverages inserted into it. The joining member 125 may comprise a semi-rigid material, having some structural elasticity. In one embodiment, the top member 120, bottom member 130, and joining member 125 may further comprise metal having a composition with structural elasticity. The structural elasticity of the top member 120, bottom member 130, and joining member 125 is configured such that the serving tray 100 includes a structurally stable body while also allowing for cushioning of the held beverages, as well as allowing stacking of multiple beverage serving trays, as shown in FIG. 5.

Figure 2B:
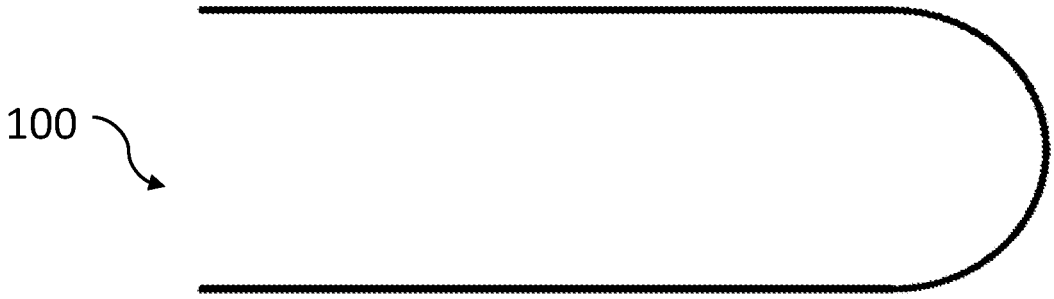
FIG. 2B illustrates a profile view of the beverage serving tray.

FIG. 2B illustrates another embodiment of the invention. The joining member 125 secures the top member 120 and the bottom member 130 at a distance appropriate for securing the desired beverage vessel within. In one embodiment, the joining member 125 is curved, forming a half-circle with a radius appropriate for the desired distance between the top member 125 and bottom member 130. In another embodiment, the joining member 125 may intersect perpendicularly with the top member 120 and bottom member 130. In yet another embodiment, the flexibility of the joining member 125 allows the top member 120 and bottom member 130 to widen the gap between the members slightly to accommodate multiple beverage serving trays stacked within the gap, as shown in FIG. 5.

In some embodiments, the top member 120, the bottom member 130, and the joining member 125 of the beverage serving tray may further comprise a plastic composition, reinforced paper composite, or another biodegradable and/or disposable material having the requisite structural stability and elasticity. The top member 120, the bottom member 130, and the joining member 125 may each also comprise the same material or different materials.

In another embodiment of the invention, the beverage serving tray may be configured to couple at least one additional beverage serving tray, such that at least one of the plurality of beverage openings of one beverage serving tray is concentric with at least one of the plurality of beverage openings of the additional beverage tray. By coupling at least one additional beverage serving tray, the number of beverage vessels that the beverage tray is capable of holding is increased. In other embodiments, additional beverage serving trays may be coupled to one another, further increasing carrying capacity of the overall beverage serving tray. In some embodiments, the beverage tray is coupled to an additional beverage serving tray by inserting a beverage vessel 630 into two concentric beverage openings in two beverage serving trays.

Figure 3A:
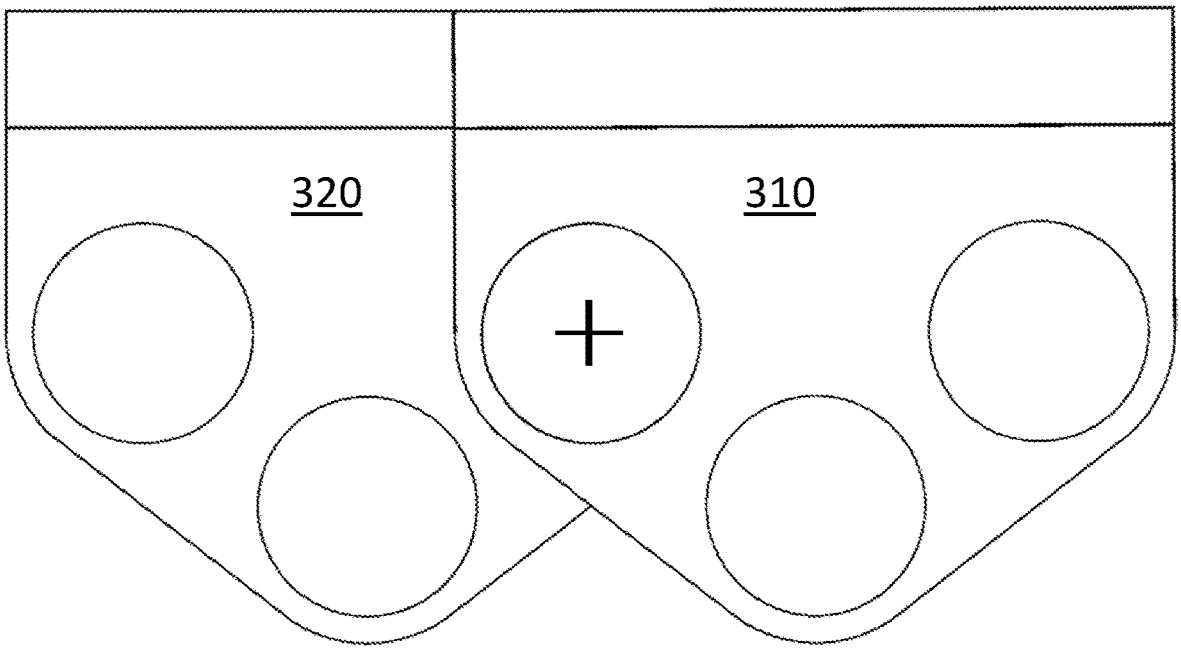
FIG. 3A illustrates a profile view of two coupled beverage serving trays.

FIG. 3A illustrates an embodiment of the invention comprising two coupled serving trays, including two serving trays each having a first top member 310 and a second top member 320. One beverage serving tray having three beverage openings may be coupled to another beverage serving tray having three openings, by lining up one beverage opening of a first top member 310 with a beverage opening of a second top member 320, such that the beverage openings are concentric. A beverage vessel 630 may then be inserted through the concentrically aligned beverage openings, thereby linking and coupling the two beverage serving trays together to form a beverage serving tray with five beverage openings, thereby increasing the capacity of the tray.

Figure 3B:
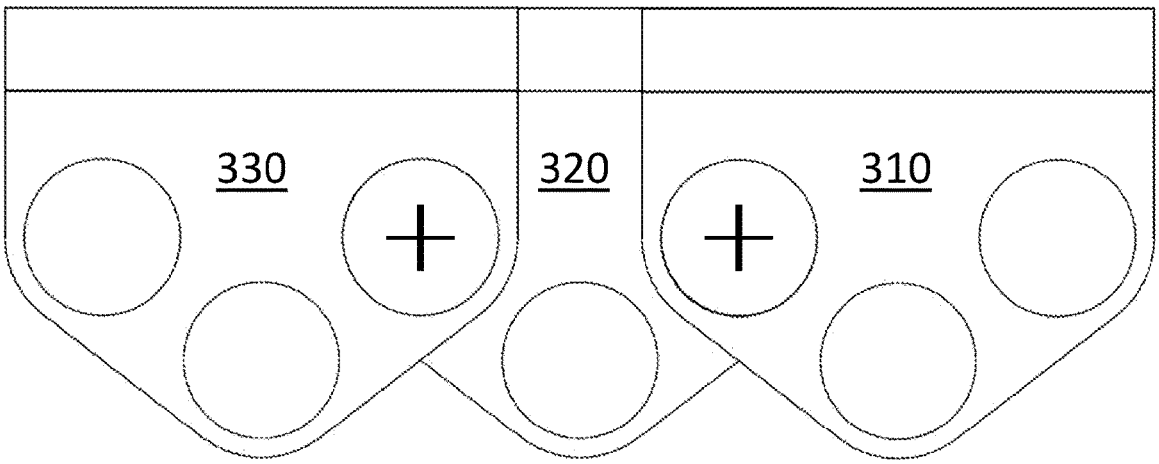
FIG. 3B illustrates a profile view of three coupled beverage serving trays.

FIG. 3B illustrates an embodiment of the invention comprising three coupled serving trays, including each of the three serving trays having a first top member 310, a second top member 320, and a third top member 330. A beverage opening of the first top member 310 is lined up with a beverage opening of the second top member 320, such that the beverage openings are concentric. A beverage opening of the third top member 330 is further lined up with a beverage opening of the second top member 320, such that the beverage openings are concentric. A beverage vessel 630 is then inserted through each of the concentrically aligned beverage openings, thereby linking and coupling the three beverage serving trays together to form a beverage serving tray with seven beverage openings, thereby increasing the capacity of the tray.

Figure 4A:
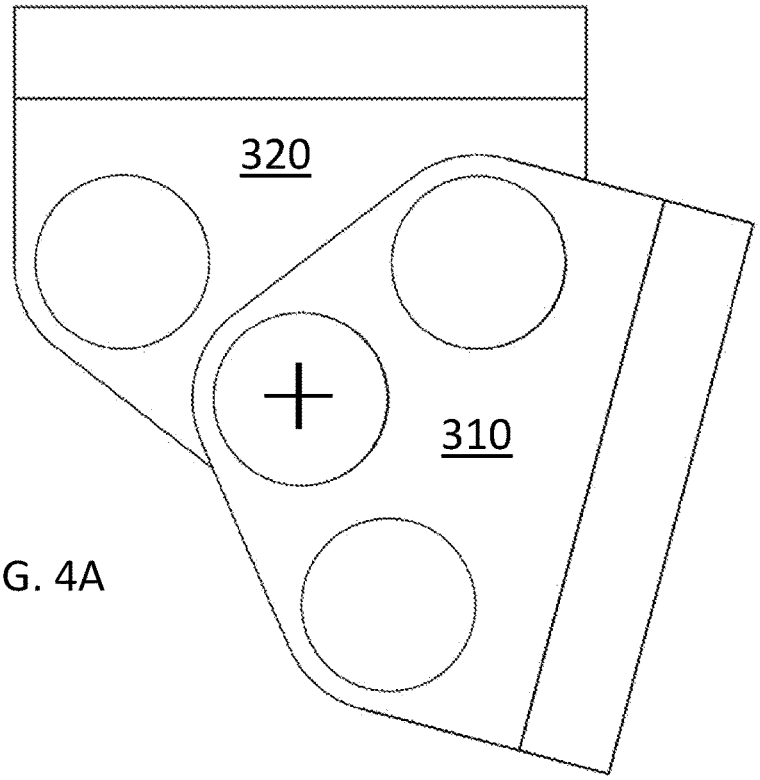
FIG. 4A illustrates a profile view of two coupled beverage serving trays.

FIG. 4A illustrates an alternate embodiment of the invention comprising two coupled serving trays, including a first top member 310 and a second top member 320. A beverage serving tray with four beverage openings is formed by aligning two beverage openings of the first tray with two beverage openings of the second tray, such that each pair of beverage openings are concentric. A beverage vessel 630 may be inserted through each of the concentric beverage openings, thereby coupling the two beverage serving trays together.

Figure 4B:
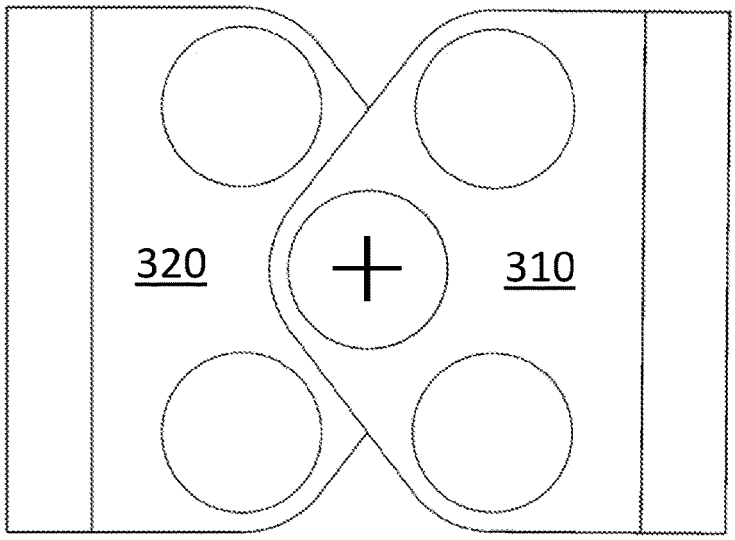
FIG. 4B illustrates a profile view of two coupled beverage serving trays.

FIG. 4B illustrates an alternate embodiment of the invention comprising two coupled serving trays, each serving tray including a first top member 310 and a second top member 320. A beverage serving tray with five beverage openings is formed by aligning one beverage opening of the first top member 310 with one beverage opening of the second top member 320, such that the beverage openings are concentric. A beverage vessel 630 may be inserted through the concentric beverage openings, thereby coupling the two serving trays together.

The beverage serving tray may further be configured to engage and stack with other beverage serving trays. FIG. 5 illustrates a side view of a stack of beverage serving trays. Each serving tray 100 may be stacked by aligning the joining member of multiple beverage serving trays, each beverage serving tray being cradled inside the other and resting against the joining member 125 of another beverage serving tray.

Further, the beverage serving tray may be loaded with beverage vessels, either filled or empty, and then stacked on top of other loaded beverage serving trays, such that the beverage serving trays may be filled with beverage vessels in advance of being ordered by a patron, thereby saving time for a person preparing and serving the beverages within the beverage serving tray. The beverage serving tray may also be loaded with non-beverage vessels, including but not limited to bowls, ramekins, and sauce dishes; allowing the beverage serving tray to assist in holding and serving food or food-related items, such as soups, sauces, dips, and condiments.

Figure 6A:
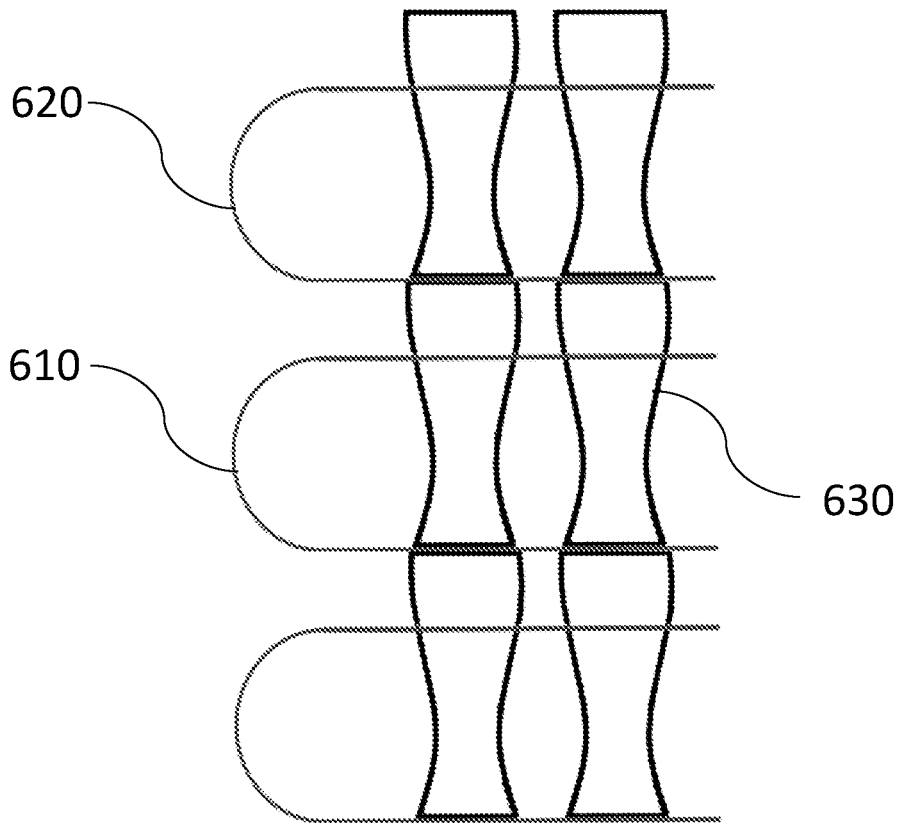
FIG. 6A illustrates a profile view of stacked beverage serving trays prior to serving.

In another embodiment of the invention, as shown in FIG. 6A, beverage serving trays may be horizontally stacked, comprising at least a first serving tray 610 and a second serving tray 620. The first serving tray 610 includes at least one beverage vessel 630. The beverage serving trays may be stacked in such a fashion in both a horizontal direction, wherein the top and bottom members of the first serving tray 610 and the second serving tray 620 are relatively parallel with a ground surface. The bottom member of the second serving tray 620 rests on the top of the beverage vessel 630.

Figure 6B:
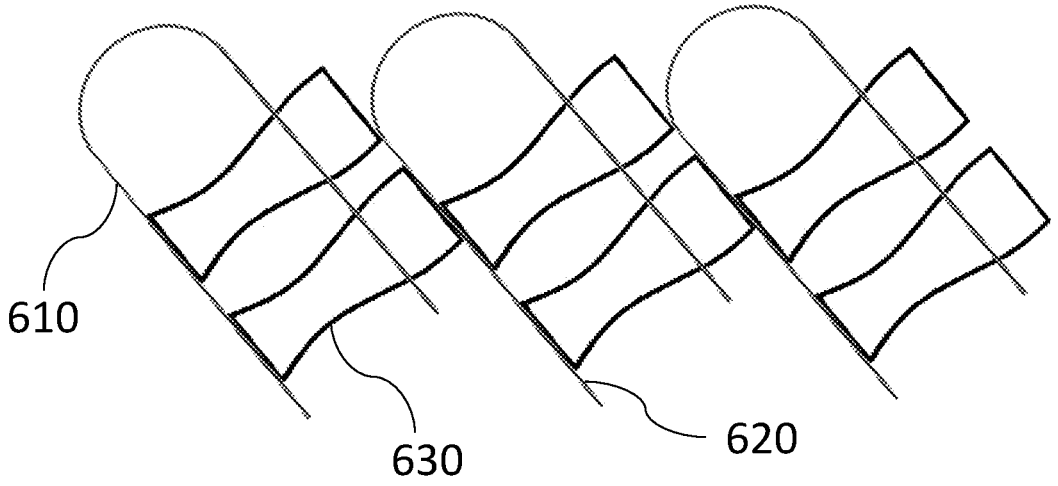
FIG. 6B illustrates a profile view of stacked beverage serving trays prior to serving.

FIG. 6B illustrates another embodiment of the invention comprising vertically stacked beverage serving trays, including at least a first serving tray 610 and a second serving tray 620. The first serving tray 610 includes at least one beverage vessel 630. The bottom member of the second serving tray 620 may rest on the top of the beverage vessel 630. In one embodiment, the top and bottom members of the first serving tray 610 may be positioned relatively perpendicular with a ground surface. In another embodiment, the top member and bottom members of the first serving tray 610 may be at an angle less than 90° with a ground surface.

Those of ordinary skill in the art will understand and appreciate that the foregoing description of the invention has been made with reference to certain exemplary embodiments of the invention, which describe a modular beverage serving tray capable of coupling other beverage serving trays to increase overall capacity and also to efficiently stack with one another. Those of skill in the art will understand that obvious variations in system configuration, protocols, parameters or properties may be made without departing from the scope of the invention which is intended to be limited only by the claims appended hereto.

What is claimed is:

1. A modular beverage serving tray, comprising:

a. a top member, wherein the top member is structurally rigid and includes at least a first opening configured to receive a beverage vessel;

b. a bottom surface, wherein the bottom surface is structurally rigid and supports the beverage vessel; and c. a joining member, wherein the joining member is physically connected to one edge of the top member and one edge of the bottom surface;

d. wherein the joining member is structurally elastic while also maintaining a stable structure with the top member and the bottom surface;

e. wherein the at least one additional beverage tray is coupled to the beverage serving tray, the at least one additional beverage tray, similar to the beverage serving tray, and comprising a top member having at least one opening, a bottom surface, and a joining member; and f. wherein the first opening of the beverage serving tray is aligned and concentric with the at least one opening of the additional beverage tray, wherein a beverage vessel is inserted through both the first opening of the beverage serving tray and the at least one opening of an additional beverage tray, configured to connect the beverage serving tray with the at least one additional beverage tray.

2. The modular beverage serving tray of claim 1, wherein at least one opening of the additional beverage tray is aligned and concentric with at least one opening of another additional beverage tray, wherein a beverage vessel is inserted through both the at least one opening of the additional beverage tray and at least one opening of another additional beverage tray, configured to connect the additional beverage tray with another additional beverage tray.

3. The modular beverage serving tray of claim 2, comprising at least three beverage trays wherein each beverage tray is configured such that at least one opening coupled to the at least one opening of another beverage tray.

4. The modular beverage serving tray of claim 1, wherein the beverage serving tray is coupled to the at least on additional beverage tray such that planes formed by the top member and the bottom surface of the beverage serving tray align with planes formed by the top member and the bottom surface of the at least one additional beverage tray; and wherein the joining member of the beverage serving tray substantially abuts the joining member of the at least one additional beverage tray.

5. The modular beverage serving tray of claim 1, wherein the joining member is comprised of a metal.

6. The modular beverage serving tray of claim 5, wherein at least one opening of the additional beverage tray is aligned and concentric with at least one opening of another additional beverage tray, wherein a beverage vessel is inserted through both the at least one opening of the additional beverage tray and at least one opening of another additional beverage tray, configured to connect the at least one additional beverage tray with another additional beverage tray.

7. The modular beverage serving tray of claim 6, comprising at least three beverage trays wherein each beverage tray is configured such that at least one opening coupled to the at least one opening of another beverage tray.

8. The modular beverage serving tray of claim 5, wherein the first beverage serving tray is coupled to the at least one additional beverage tray such that planes formed by the top member and the bottom surface of the beverage serving tray align with planes formed by the top member and the bottom surface of the at least one additional beverage tray; and wherein the joining member of the beverage serving tray substantially abuts the joining member of the at least one additional beverage tray.

9. The modular beverage serving tray of claim 1, configured such that the beverage serving tray having at least one beverage vessel disposed within an opening thereof may be removably coupled to at least one additional beverage tray, the at least one additional beverage tray also having at least one beverage vessel disposed within an opening thereof.

10. The modular beverage serving tray of claim 1, wherein at least one of either the first opening or the at least one opening is further configured to receive a food or food-related vessel.

* * * * *